United States Patent [19]

Hughes

[11] 4,102,166

[45] Jul. 25, 1978

[54] KEY BOW COVER

[76] Inventor: Donald R. Hughes, 2600 Brower Ave., Simi Valley, Calif. 93065

[21] Appl. No.: 845,397

[22] Filed: Oct. 25, 1977

Related U.S. Application Data

[63] Continuation of Ser. No. 718,014, Aug. 26, 1976, abandoned.

[51] Int. Cl.[2] ..... E05B 19/04; A47G 29/10

[52] U.S. Cl. ..... 70/456 R; 70/408

[58] Field of Search ..... 70/408, 456 R, 456 B, 70/457, 458, 459; 206/0.8, 0.81, 0.82, 0.83, 0.84

[56] References Cited

U.S. PATENT DOCUMENTS

| | | | |
|---|---|---|---|
| 917,894 | 4/1909 | Pjsterla | 70/408 |
| 1,889,471 | 11/1932 | Glaenzer | 70/456 R |
| 2,559,946 | 7/1951 | Craig | 70/456 R |
| 3,349,589 | 10/1967 | Fricke | 70/456 R |

*Primary Examiner*—Robert L. Wolfe

*Attorney, Agent, or Firm*—Jack C. Munro

[57] ABSTRACT

A key bow cover which is adapted to be placed around the bow of a key and is composed of a pair of plates which are hingedly connected together by a rivet or other similar fastening means at the top end of the cover. The bow of the key is adapted to totally fit within one of the plates with there still being sufficient excess space to insert a money coin, such as a dime in United States currency. There is sufficient space in the other of the plates to also insert a similar coin. When the plates are located together to completely enclose the internal chambers, there is a fastening means provided to secure together the plates. Whenever it is desired, the cover can be opened and the dimes removed and used for whatever purpose deemed necessary, such as a telephone call. An insert is to be normally used within the cover to matingly cooperate within the opening provided by the joined pair of plates. A second opening is provided within the insert to matingly fit with the particular shape of key bow.

5 Claims, 9 Drawing Figures

KEY BOW COVER

This is a continuation, of application Ser. No. 718,014 filed Aug. 26, 1976 and now abandoned.

BACKGROUND OF THE INVENTION

Keys are extremely common in almost everyone's day to day life. There are keys for your car, there are keys for your boat, keys for your house, keys for your business, and so forth. Practically everyone has a key on their person or within their reach, no matter what their location, or what that person is doing.

Although a person always has a key, a person does not necessarily have money on his person and particularly money in the form of a ten cent piece on his person. A ten cent piece (or dime) can be used to make a phone call at a conventional pay telephone. Phone calls cannot be made with paper currency, but can only be made with metallic currency.

Prior to the subject matter of this invention, there has been no known key bow device which combines the conventional key with an element of currency thereby providing sufficient currency on the person at almost all times (since a person will normally have a key on his person at all times) so that the person will be able to at least make a single phone call.

SUMMARY OF THE INVENTION

The subject matter of this invention is believed to be summarily described in the Abstract Of The Disclosure and reference is to be had thereto.

The primary objective of this invention is to provide an element of currency within a key bow cover so that the key and its connected cover can be used as normal with there being one or two dimes enclosed within the key bow cover that are available for use at any selected time.

Another objective of this invention is that it can be made out of plastic, wood or metal material and can be readily inexpensively manufactured and sold.

Another objective of this invention is that once the dimes have been used from the cover, the key cover can be replaced in the closed position and used in a normal manner in conjunction with a key. At some later point in time the dimes can be replaced, put back in the cover, thereby making the device of this invention reuseable.

Another objective of this invention is that the compartments contained within the cover may have inserted therein one or more additional items, such as a photograph, an identification plate, or other such devices causing the device to also have the additional function of a locket.

A secondary advantage is that because of the psychological impression that person will be less inclined to leave their car unattended with the keys in it due to the fact that the keys also contain some amount of money.

A further advantage of this invention is that the compartments within the key bow cover can be used as a container for pills which may be necessary for an emergency treatment for heart trouble, or the like.

The device of this invention can be manufactured in a single size or a plurality of sizes which are adapted to fit most key bows.

A further objective of this invention is that the key bow cover can be manufactured to adapt to all key configurations.

Another objective of this invention is that it can be manufactured in any color and of any rigid material.

The cover of this invention can be manufactured of a opaque material or a transparent material which respectively will alternately cause the dimes to be hidden or to be readily observed.

Figure 1:
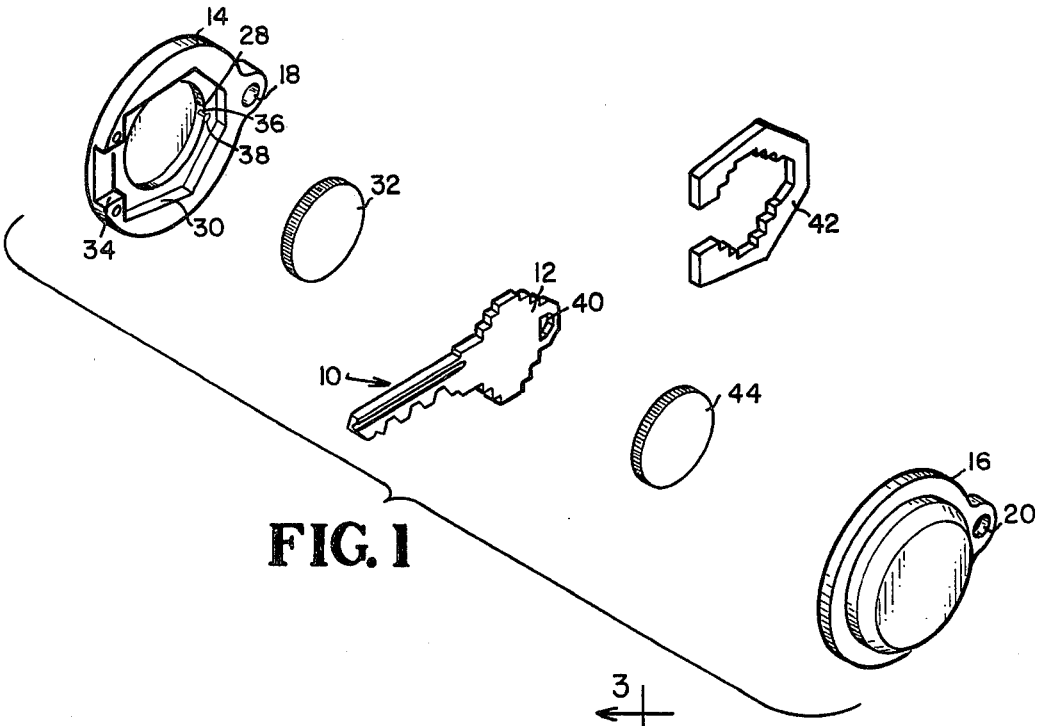
FIG. 1 is an exploded isometric view of the key bow cover of this invention showing how such could be employed in combination with two coins and a conventional key.

FIGS. *6a* to *6d* illustratively show different shapes of inserts which may be employed in conjunction with the cover of this invention.

DETAILED DESCRIPTION OF THE SHOWN EMBODIMENT

Referring particularly to the drawing, there is shown a conventional key 10 which has a key bow 12. The key bow cover of this invention is composed of a first plate 14 and a second plate 16. At the upper end of the plate 14 is located an opening 18 and a similar such opening 20 is formed within the plate 16. When the plates 14 and 16 are located together in an abutting side by side relationship and the openings 18 and 20 aligned, a rivet 22 is to be placed within the aligned openings thereby connecting together the plates 14 and 16. About the rivet 22 the plate 16 can be rotated with respect to the plate 14.

When the plates 14 and 16 are in an abutting relationship, the snaps 24 and 26 are employed to lock together the plates 14 and 16 into a single unit.

Within the plate 14 there is located an interior chamber which is divided into a coin receiving chamber 28 and a key bow receiving chamber 30. A coin 32, such as a dime, is to be placed within the chamber 28. The key bow 12 is to be placed within the chamber 30. The shank portion of the key 10 is to extend through slot 34 formed within the plate 14.

It is to be noted that with the dime 32 in position within the chamber 28 and the key bow 12 located within the chamber 30, that the exposed surface of the key bow 12 will lie substantially flush with the inner surface of the plate 14.

In order to prevent accidental dislodgement of the key 10 when the cover of this invention is opened, a retaining means in the form of an elongated pin 36 is provided. This pin 36 has an enlarged head 38. The pin 36 is attached to the plate 14. An opening 40 is provided within the key bow 12 and key bows include some type of an opening, such as opening 40. The member 36 is to be extended through the opening 40 and because of the somewhat enlarged head 38, there will be a tendency for the key 10 to remain in position when the device is open and not be accidentally dislodged. The portion of the exposed surface of the key bow 12 should rest against the inside of the enlarged head 38.

Regarding the plate 16, an interior coin receiving chamber 42 is provided within which is to be located a similar such coin 44. No portion of the key 10 extends within the plate 16 so that unhindered rotation of the plate 16 in respect to plate 14 is accomplished. If the key 10 actually occupied both a portion of plate 14 and 16, then movement of one plate with respect to the other would be prevented inherently by the key itself. It is for this reason that the key bow 12 extends entirely within the plate 14.

Figure 3:
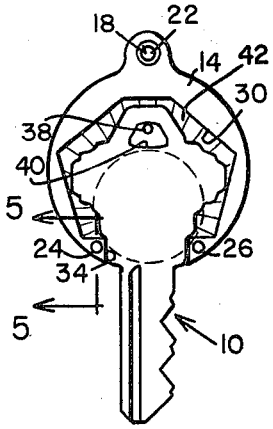
FIG. 3 is a interior side view taken along line 3—3 of FIG. 2.
Figure 2:
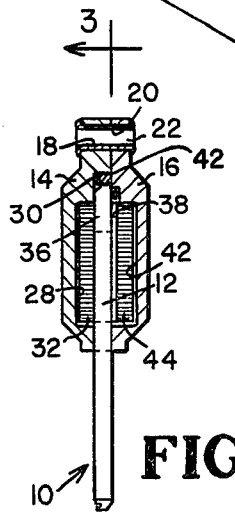
FIG. 2 is a cross-sectional view through the assembled cover of this invention.
Figure 5:
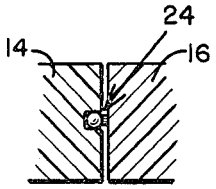
FIG. 5 is an enlarged segmental view of one of the snaps employed to connect with the cover.
Figure 4:
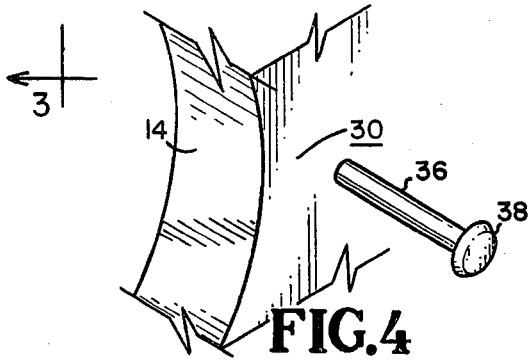
FIG. 4 is an enlarged view of the pin which is located within the cover which connects with the key.
Figure 6A:
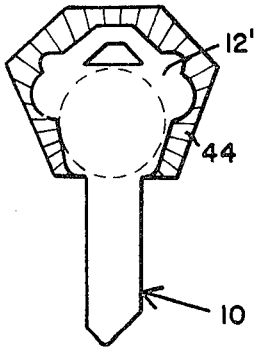
Figure 6B:
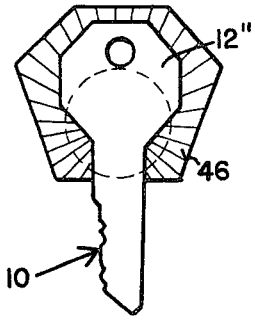
Figure 6C:
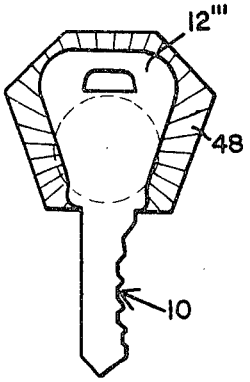
Figure 6D:
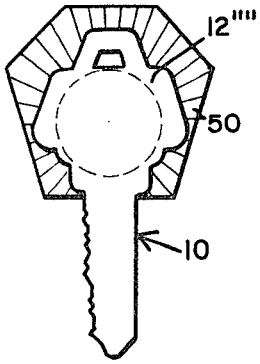

It is desirable to tightly or snugly position the key bow within chamber 30. To accomplish this, there will be available several different inserts each of which is of a particular design to be located about a particular key bow. Examples of such inserts are the insert 42 shown in FIGS. 1-3, insert 44 in FIG. *6a*, insert 46 in FIG. *6b*, insert 48 in FIG. *6c* and insert 56 in FIG. *6d*.

What is claimed is:

1. A key bow cover comprising:

a first plate having a first internal chamber;

a second plate having a second internal chamber, said second plate being hingedly connected to said first plate so that said second plate may be moved relative to said first plate permitting access into said first and said second interior chambers;

fastener means interconnecting said first and said second plates, said fastening means when operable maintaining said first and said second plates in an abutting relationship with said first and said second interior chambers cooperating together to form a single closed chamber, with said fastening means being disconnected said second plate being capable of being hingedly moved relative to said first plate;

said first interior chamber being substantially twice the size of said second interior chamber, whereby the bow of a key and a coin may be placed within said first interior chamber and a second coin placed within said second interior chamber;

said fastening means comprises a pair of spaced apart snaps;

a key bow retaining means attached to said first plate and located within said first internal chamber, said key bow retaining means adapted to connect with the bow of a key when placed within said first internal chamber and functions to normally prevent accidental disassociation of the key from said first internal chamber when said first internal chamber is exposed;

said retaining means comprises an elongated projection having an enlarged head which is adapted to be placed through an appropriate opening formed within the bow of a key; and an insert located about the key bow and within said first interior chamber.

2. A key bow cover comprising:

a first plate having a first internal chamber;

a second plate having a second internal chamber, said second plate being hingedly connected to said first plate within a hinge plane so that said second plate may be moved relative to said first plate permitting access into said first and said second interior chambers;

fastener means interconnecting said first and said second plates, said fastener means when operable maintaining said first and said second plates in an abutting relationship with said first and said second interior chambers cooperating together to form a single closed chamber, with said fastener means being disconnected said second plate being capable of being hingedly moved within said hinge plane relative to said first plate; and said first interior chamber being substantially twice the size of said second interior chamber, the longest central axis of each said first internal chamber and said second internal chamber being continuously parallel to said hinge plane, whereby the bow of a key and a coin may be placed within said first interior chamber and a second coin placed within said second interior chamber.

3. The key bow cover as defined in claim 2 wherein:

said fastener means comprises a pair of spaced apart snaps.

4. The key bow cover as defined in claim 3 including:

a key bow retaining means attached to said first plate and located within said first internal chamber, said key bow retaining means adapted to connect the bow of the key when placed within said first internal chamber and functions to normally prevent accidental disassociation of the key from said first internal chamber when said first internal chamber is exposed.

5. The key bow cover as defined in claim 4 wherein:

said retaining means comprises an elongated projection having an enlarged head which is adapted to be placed through an appropriate opening formed within the bow of a key.

* * * * *